US011618272B2

(12) United States Patent
Hiramatsu

(10) Patent No.: US 11,618,272 B2
(45) Date of Patent: Apr. 4, 2023

(54) PRINTING APPARATUS

(71) Applicant: BROTHER KOGYO KABUSHIKI KAISHA, Nagoya (JP)

(72) Inventor: Yuki Hiramatsu, Nukata-gun (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 163 days.

(21) Appl. No.: 17/169,437

(22) Filed: Feb. 6, 2021

(65) Prior Publication Data

US 2021/0245536 A1 Aug. 12, 2021

(30) Foreign Application Priority Data

Feb. 12, 2020 (JP) ..... JP2020-021214

(51) Int. Cl.
*B41J 2/355* (2006.01)
*B41J 3/407* (2006.01)
*B41J 29/393* (2006.01)

(52) U.S. Cl.
CPC ..... *B41J 29/393* (2013.01); *B41J 2/3558* (2013.01); *B41J 3/4075* (2013.01); *B41J 2029/3932* (2013.01)

(58) Field of Classification Search
CPC ..... B41J 29/393; B41J 2/3558; B41J 3/4075; B41J 29/38; B41J 2029/3932; B41J 2/35
See application file for complete search history.

(56) References Cited

U.S. PATENT DOCUMENTS

2005/0058484 A1 3/2005 Nagae et al.

FOREIGN PATENT DOCUMENTS

JP 2003341192 * 12/2003 ..... B41J 29/38
JP 2005-74768 A 3/2005
JP 2017-70145 A 4/2017

* cited by examiner

*Primary Examiner* — Kristal Feggins
(74) *Attorney, Agent, or Firm* — Kenealy Vaidya LLP

(57) ABSTRACT

A printing apparatus including: a thermal head; a capacitor capable of being charged and discharged; a detection unit configured to detect a voltage of the capacitor; a battery accommodation part configured to accommodate a dry-cell battery configured to supply electric power for charging the capacitor; a charging unit configured to charge the capacitor by the electric power of the dry-cell battery; and a controller configured to: execute charging control of controlling the charging unit to charge the capacitor by the electric power of the dry-cell battery, and execute printing control of performing printing on a printing medium by driving the thermal head only with the electric power charged in the capacitor, depending on the voltage detected by the detection unit.

14 Claims, 6 Drawing Sheets

PRINTING APPARATUS

CROSS-REFERENCE TO RELATED APPLICATIONS

This application is based upon and claims the benefit of priority from prior Japanese patent application No. 2020-021214, filed on Feb. 12, 2020, the entire contents of which are incorporated herein by reference.

TECHNICAL FIELD

The present disclosure relates to a printing apparatus.

BACKGROUND ART

Known is a battery-drivable printing apparatus. For example, related-art discloses a tape printing apparatus that can be driven by a dry-cell battery. The tape printing apparatus includes a thermal head. When performing printing in a thermal transfer method, the tape printing apparatus heats a print ribbon by the thermal head to transfer ink of the print ribbon to a tape for printing. When performing printing in a heat-sensitive method, the tape printing apparatus heats a heat-sensitive color developing tape having a heat-sensitive color developing layer to develop a color of the heat-sensitive color developing layer. The tape printing apparatus is driven by electric power that is supplied from six dry-cell batteries accommodated in a battery accommodation part.

In a case of a printing apparatus configured to perform printing in the thermal transfer method or the heat-sensitive method, in many cases, large electric power is required so as to drive the thermal head. In order to enable the drive by the dry-cell batteries, like the above-described tape printing apparatus, it is necessary to secure the electric power by increasing the number of the dry-cell batteries. In this case, since a space for accommodating the dry-cell batteries increases, it is difficult to miniaturize and lighten the printing apparatus. On the other hand, when the number of the dry-cell batteries is insufficient, the thermal head cannot be driven as appropriate, so that a print quality may be lowered.

SUMMARY

Aspects of the present disclosure provide a printing apparatus that is driven by a dry-cell battery and can be miniaturized and lightened while keeping a print quality.

According to a first aspect of the present disclosure, there is provided a printing apparatus including: a thermal head; a capacitor capable of being charged and discharged; a detection unit configured to detect a voltage of the capacitor; a battery accommodation part configured to accommodate a dry-cell battery configured to supply electric power for charging the capacitor; a charging unit configured to charge the capacitor by the electric power of the dry-cell battery; and a controller configured to: execute charging control of controlling the charging unit to charge the capacitor by the electric power of the dry-cell battery, and execute printing control of performing printing on a printing medium by driving the thermal head only with the electric power charged in the capacitor, depending on the voltage detected by the detection unit.

According to a second aspect of the present disclosure, there is provided a printing apparatus including: a printing unit; a first power supply capable of being charged and discharged; a detection unit configured to detect a voltage of the first power supply; a battery accommodation part configured to accommodate a second power supply configured to supply electric power for charging the first power supply; a charging unit configured to charge the first power supply by the electric power of the second power supply; and a controller configured to: execute charging control of controlling the charging unit to charge the first power supply by the electric power of the second power supply, and execute printing control of performing printing on a printing medium by driving the printing unit only with the electric power charged in the first power supply, depending on the voltage detected by the detection unit.

DESCRIPTION OF EMBODIMENTS

<Summary of Printing Apparatus 1>

An embodiment of the present disclosure will be described with reference to the drawings. A printing apparatus 1 can prepare a label by printing a character, a character string, a symbol, a number, a figure, a figure character and the like (hereinbelow, referred to as "print information") on a tape 50 (refer to FIG. 3) that is a printing medium. In descriptions below, the left upper side, the right lower side, the right upper side, the left lower side, the upper side and the lower side of FIG. 1 are each referred to as the left side, the right side, the upper side, the lower side, the front side and the rear side of the printing apparatus 1.

Figure 1:
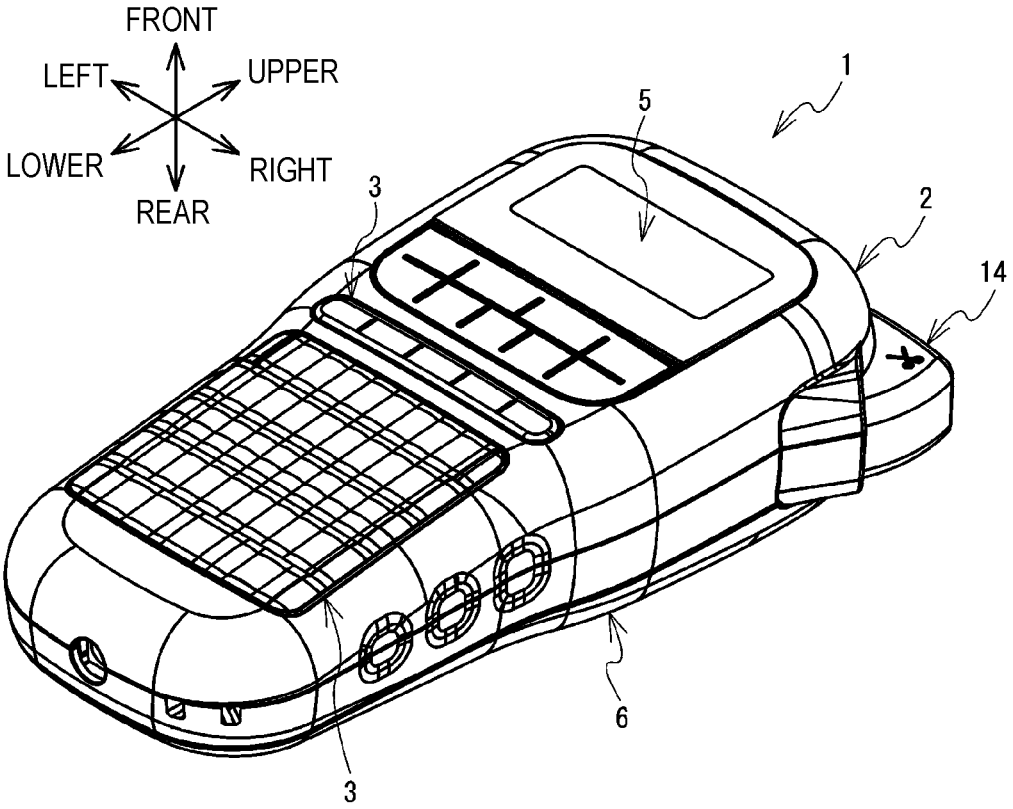
FIG. 1 is a perspective view of a printing apparatus 1, as seen from the front side.

As shown in FIG. 1, the printing apparatus 1 has a main body cover 2 that is a cuboid housing. A front part of an upper surface of the main body cover 2 is provided with a keyboard 3 for inputting a character string and the like. The keyboard 3 includes a power supply switch, usage keys, cursor keys and the like. An upper side of the keyboard 3 is provided with a display 5 for displaying a variety of information. As an example, the display 5 is a dot matrix LCD. A rear side of the display 5 is provided with a cassette cover 6 that can be opened and closed with respect to the main body cover 2. The upper surface of the main body cover 2 is provided with a discharge port 9 (refer to FIG. 2) for discharging a printed tape 50 to an outside of the main body cover 2. A corner portion on a right upper side of the main body cover 2 is provided with an operation unit 14. The operation unit 14 is pressed inwardly, so that the printed tape is cut.

Figure 2:
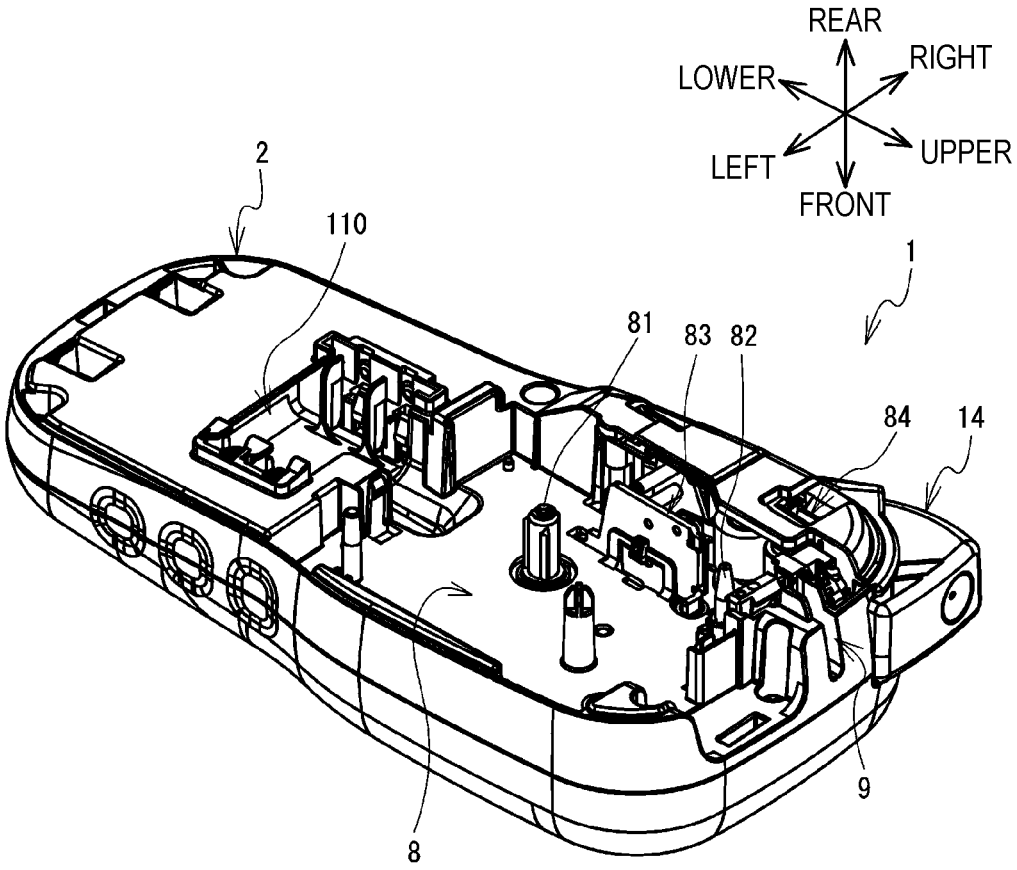
FIG. 2 is a perspective view of the printing apparatus 1 in a state where a cassette cover 6 is detached, as seen from the rear side.

As shown in FIG. 2, a front side of the cassette cover 6 (refer to FIG. 1) inside the main body cover 2 is provided with a mounting part 8 and a battery accommodation part 110. The mounting part 8 is a concave part corresponding to a shape of a tape cassette 30 (refer to FIG. 3) which will be described later, and is a part to which the tape cassette 30 can be detachably mounted. The printing apparatus 1 is configured to execute printing of a character string input via the keyboard 3 by using the tape cassette 30 mounted to the mounting part 8. In the battery accommodation part 110, four dry-cell batteries 11A to 11D (refer to FIG. 5) that are a supply source of electric power necessary for the printing apparatus 1 to execute printing are accommodated. The dry-cell batteries 11A to 11D are each a 1.5V AAA dry-cell battery.

Figure 3:
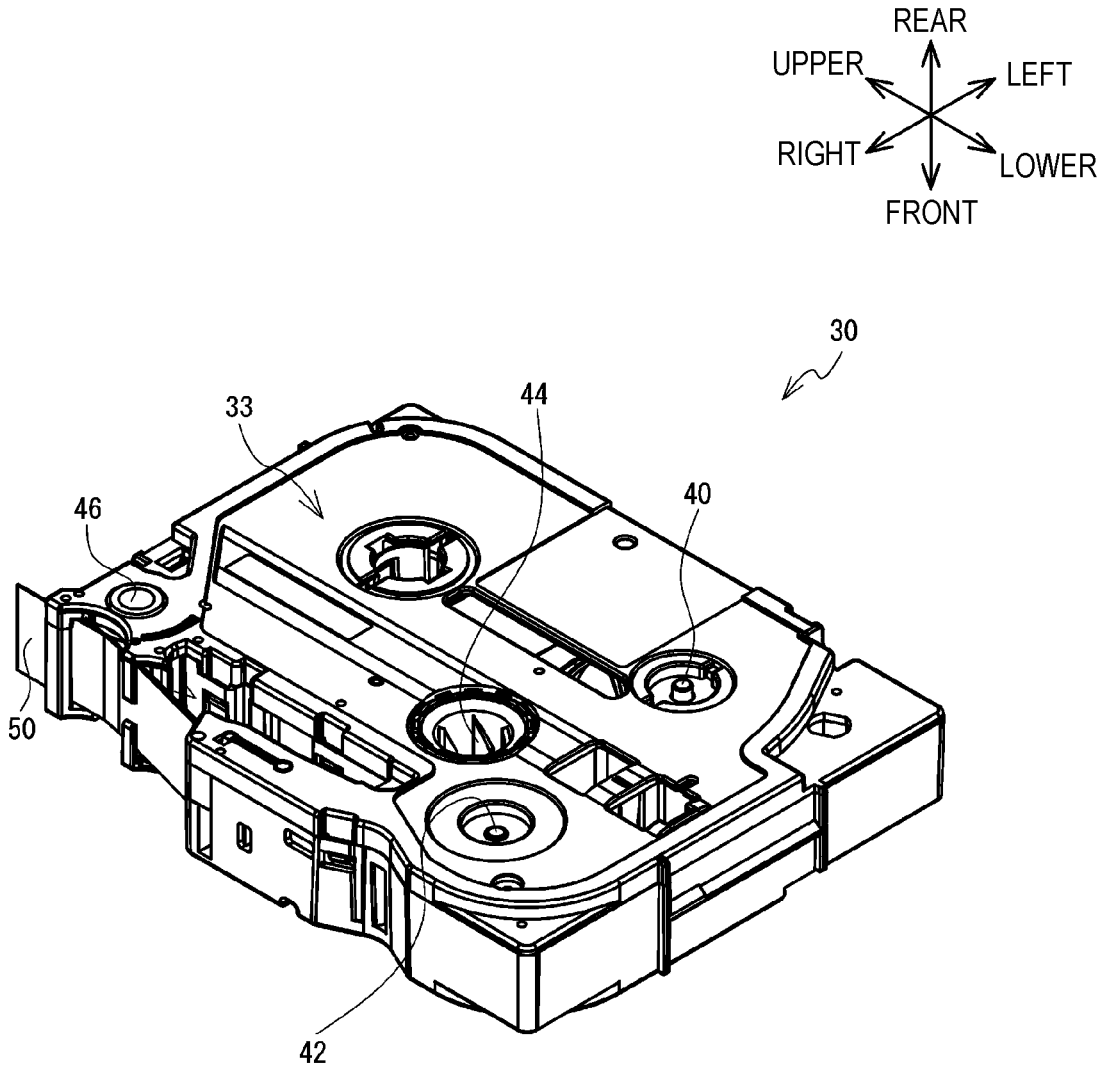
FIG. 3 is a perspective view of a tape cassette 3.

As shown in FIG. 3, the tape cassette 30 has a box-shaped cassette case 33 in which a tape 50, an ink ribbon (not shown) and the like are accommodated. A tape spool 40 on which the tape 50 before printing is wound is rotatably supported at a left lower part in the cassette case 33. A ribbon spool 42 on which the unused ink ribbon is wound is rotatably supported at a right lower part in the cassette case 33. A ribbon winding spool 44 is disposed in a position shifted to a right lower side from a center in the cassette case 33 and is rotatably supported. The ribbon winding spool 44 pulls out the unused ink ribbon from the ribbon spool 42, and winds up the ink ribbon used for printing. A tape drive roller 46 is rotatably supported at a right upper corner portion in the cassette case 33, and pulls out the tape 50 before printing from the tape spool 40.

As shown in FIG. 2, the mounting part 8 is provided with a ribbon winding shaft 81, a tape drive shaft 82, a thermal head 83, a platen mechanism 84, and the like. The ribbon winding shaft 81 is inserted in the ribbon winding spool 44 (refer to FIG. 3) of the tape cassette 30, and is rotated by drive of a tape feeding motor 23 (refer to FIG. 4). The tape drive shaft 82 is inserted in the tape drive roller 46 (refer to FIG. 3) of the tape cassette 30, and is rotated via a transmission mechanism (not shown) by drive of the tape feeding motor 23. The thermal head 83 is disposed below the tape drive shaft 82.

The printing apparatus 1 is configured to feed and convey the tape 50 from the tape spool 40 of the tape cassette 30 by drive of the tape drive shaft 82. The printing apparatus 1 is configured to heat the unused ink ribbon by the thermal head 83, and to perform printing on the tape 50. The printing apparatus 1 is configured to press and convey the tape 50 and the ink ribbon to the thermal head 83 by drive of the platen mechanism 84.

<Electrical Configuration of Printing Apparatus 1>

Figure 4:
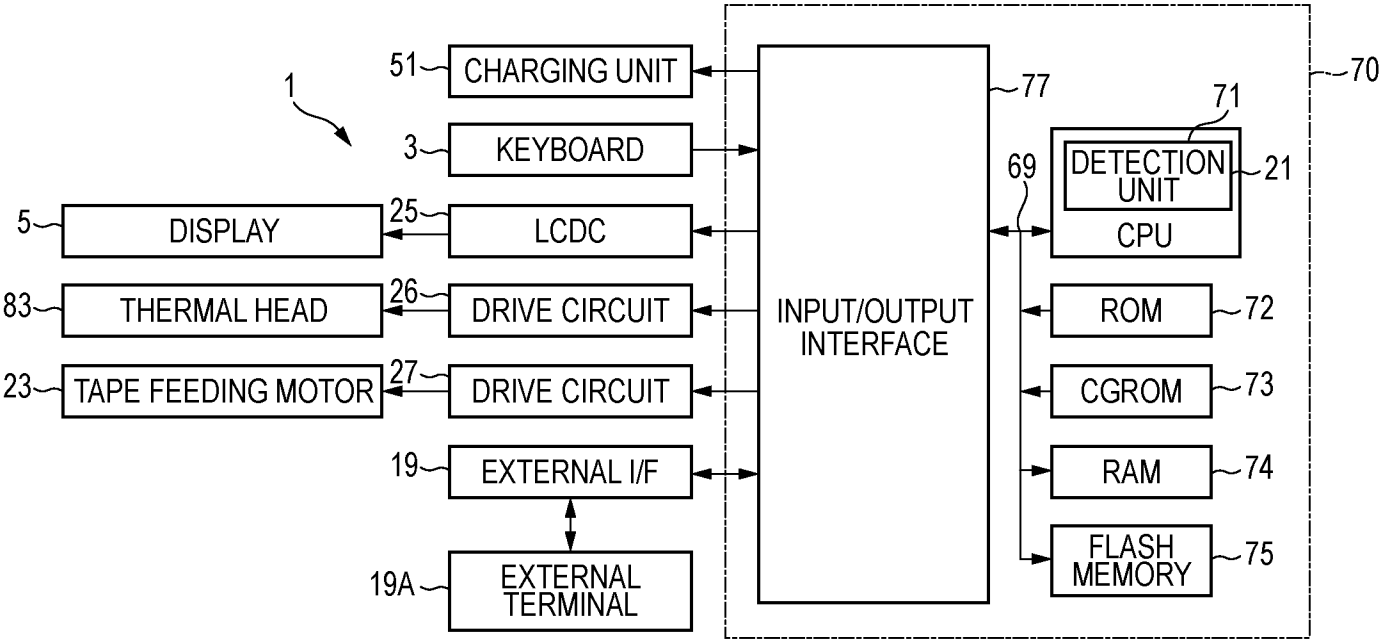
FIG. 4 is a block diagram depicting an electrical configuration of the printing apparatus 1.

An electrical configuration of the printing apparatus 1 is described with reference to FIG. 4. The printing apparatus 1 includes a control circuit unit 70. The control circuit unit 70 includes a CPU 71, a ROM 72, a CGROM 73, a RAM 74, a flash memory 75, and an input/output interface 77, which are connected via a data bus 69. The CPU 71 is configured to collectively control the printing apparatus 1. The CPU 71 includes a detection unit 21 (which will be described later) configured by an AD converter. In the ROM 72, constants that are necessary for the CPU 71 to execute diverse programs are stored. In the CGROM 73, build-in fonts and the like are stored. The RAM 74 has a plurality of storage areas such as a text memory, a printing buffer and the like. In the flash memory 75, a variety of programs that are executed by the CPU 71, variables and the like are stored. The variables that are stored in the flash memory 75 include a first threshold value Vth(1), a second threshold value Vth(2), a printing threshold value Vcut, and the like, which will be described later.

The input/output interface 77 is connected to a charging unit 51, the keyboard 3, a liquid crystal drive circuit (LCDC) 25, drive circuits 26 and 27, and an external interface (I/F) 19. The LCDC 25 includes a video RAM (not shown) for outputting display data to the display 5. The drive circuit 26 is an electronic circuit for driving the thermal head 83. The drive circuit 27 is an electronic circuit for driving the tape feeding motor 23. The external I/F 19 connects to an external terminal 19A (not shown) and performs communication. For example, the CPU 71 can update a program by storing a program received from the external terminal 19A in the flash memory 75. The external terminal 19A is a general purpose personal computer (PC) or a mobile terminal. The charging unit 51 will be described in detail later.

<Power Supply System Diagram of Printing Apparatus 1>

Figure 5:
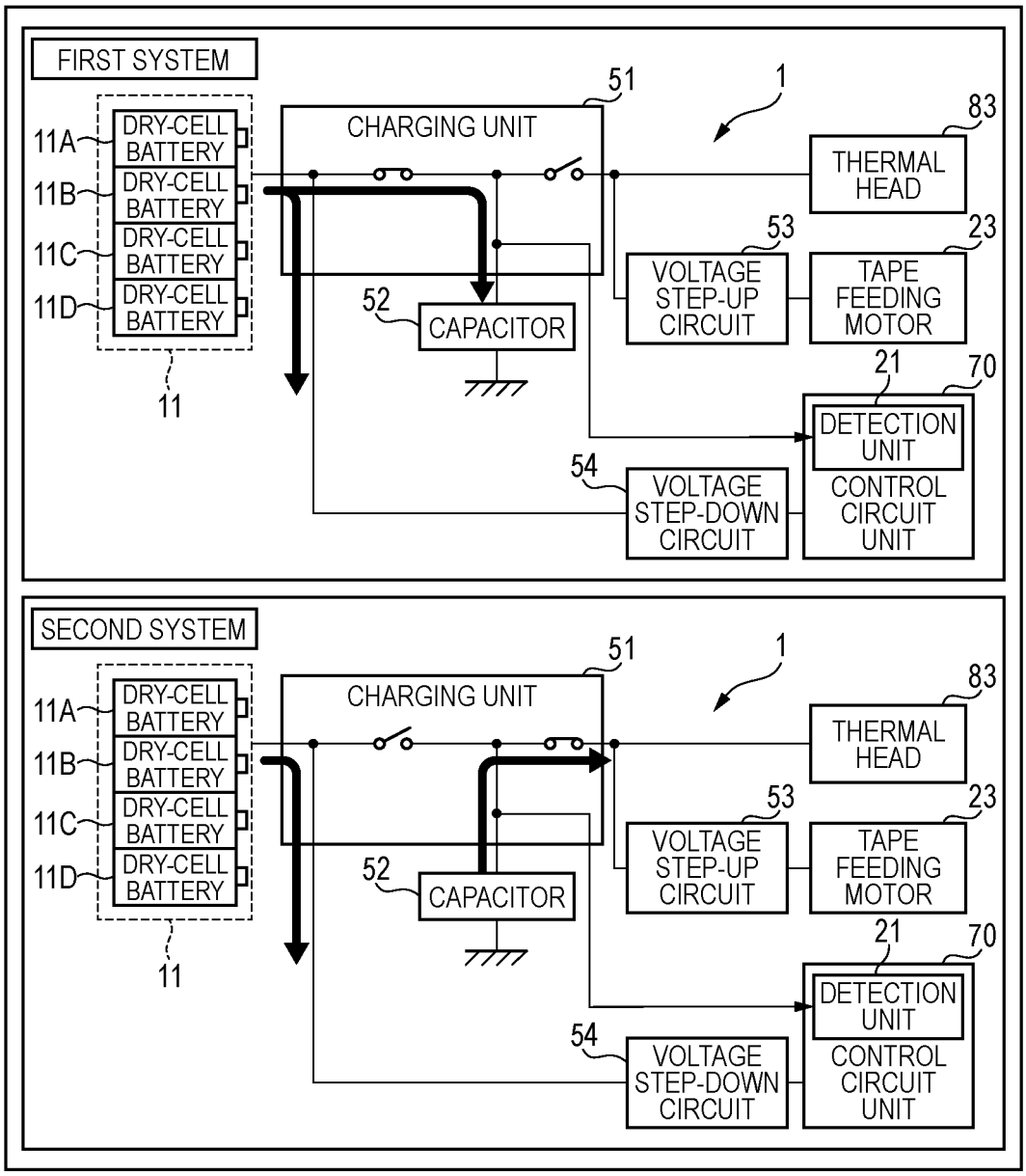
FIG. 5 depicts a power supply system of the printing apparatus 1.

A part of a power supply system of the printing apparatus 1 is described. As shown in FIG. 5, as a power supply for the printing apparatus 1 to execute printing, the four dry-cell batteries 11A to 11D (hereinbelow, collectively referred to as the dry-cell battery 11) connected in series are used. The dry-cell battery 11 is an AAA primary battery. The power supply system diagram shown in FIG. 5 depicts a power supply system between the thermal head 83, the tape feeding motor 23, the control circuit unit 70 and the dry-cell battery 11. A power supply system between the other devices and the dry-cell battery 11 is not shown.

The charging unit 51 is interposed between the dry-cell battery 11 and the thermal head 83. The charging unit 51 and a voltage step-up circuit 53 are interposed between the dry-cell battery 11 and the tape feeding motor 23. One terminal of the capacitor 52 is connected to the charging unit 51 and the detection unit 21 in the control circuit unit 70. The other terminal of the capacitor 52 is connected to the ground. The charging unit 51 and a voltage step-down circuit 54 are interposed between the dry-cell battery 11 and the control circuit unit 70.

The charging unit 51 is configured to always supply the electric power of the dry-cell battery 11 to the control circuit unit 70 via the voltage step-down circuit 54. The charging unit 51 is also configured to switch a state in which the electric power of the dry-cell battery 11 is supplied to the capacitor 52 and a state in which the electric power is not supplied. Hereinbelow, a power supply system in which the electric power of the dry-cell battery 11 is supplied to the capacitor 52 and the control circuit unit 70 is referred to as a first system. A power supply system in which the electric power of the dry-cell battery 11 is supplied to only the control circuit unit 70 and is not supplied to the capacitor 52 is referred to as a second system. The charging unit 51 can switch the power supply system between the first system and the second system, according to a command from the CPU 71 of the control circuit unit 70.

The capacitor 52 is a lithium-ion capacitor that can be charged and discharged. The lithium-ion capacitor is a capacitor whose negative electrode is doped in advance with lithium ions, and can be used at higher voltages (about 4.0V), as compared to a usual electric double layer capacitor. In a state where the charging unit 51 switches the power supply system to the first system, the electric power for charging the capacitor 52 is supplied from the dry-cell battery 11 to the capacitor 52. That is, the charging unit 51 can charge the capacitor 52 with the electric power of the dry-cell battery 11 by switching the power supply system to the first system.

The thermal head 83 is configured to generate heat as the electric power charged in the capacitor 52 is supplied thereto, and to heat the ink ribbon to perform printing on the tape 50. The tape feeding motor 23 is configured to rotate as the electric power charged in the capacitor 52 is supplied via the voltage step-up circuit 53. As the tape feeding motor 23 rotates, the tape drive shaft 82 is rotated to convey the tape 50. The voltage step-up circuit 53 increases a voltage of the capacitor 52 to a voltage at which the tape feeding motor 23 can be driven.

The diverse devices (the CPU 71 and the like) included in the control circuit unit 70 are driven by the electric power supplied from the dry-cell battery 11 via the charging unit 51 and the voltage step-down circuit 54. The voltage step-down circuit 54 lowers a voltage of the dry-cell battery 11 to a voltage at which the diverse devices included in the control circuit unit 70 can be driven. The detection unit 21 included in the CPU 71 (refer to FIG. 4) is connected to one terminal of the capacitor 52 and can detect the voltage of the capacitor 52.

<Main Processing>

Figure 6:
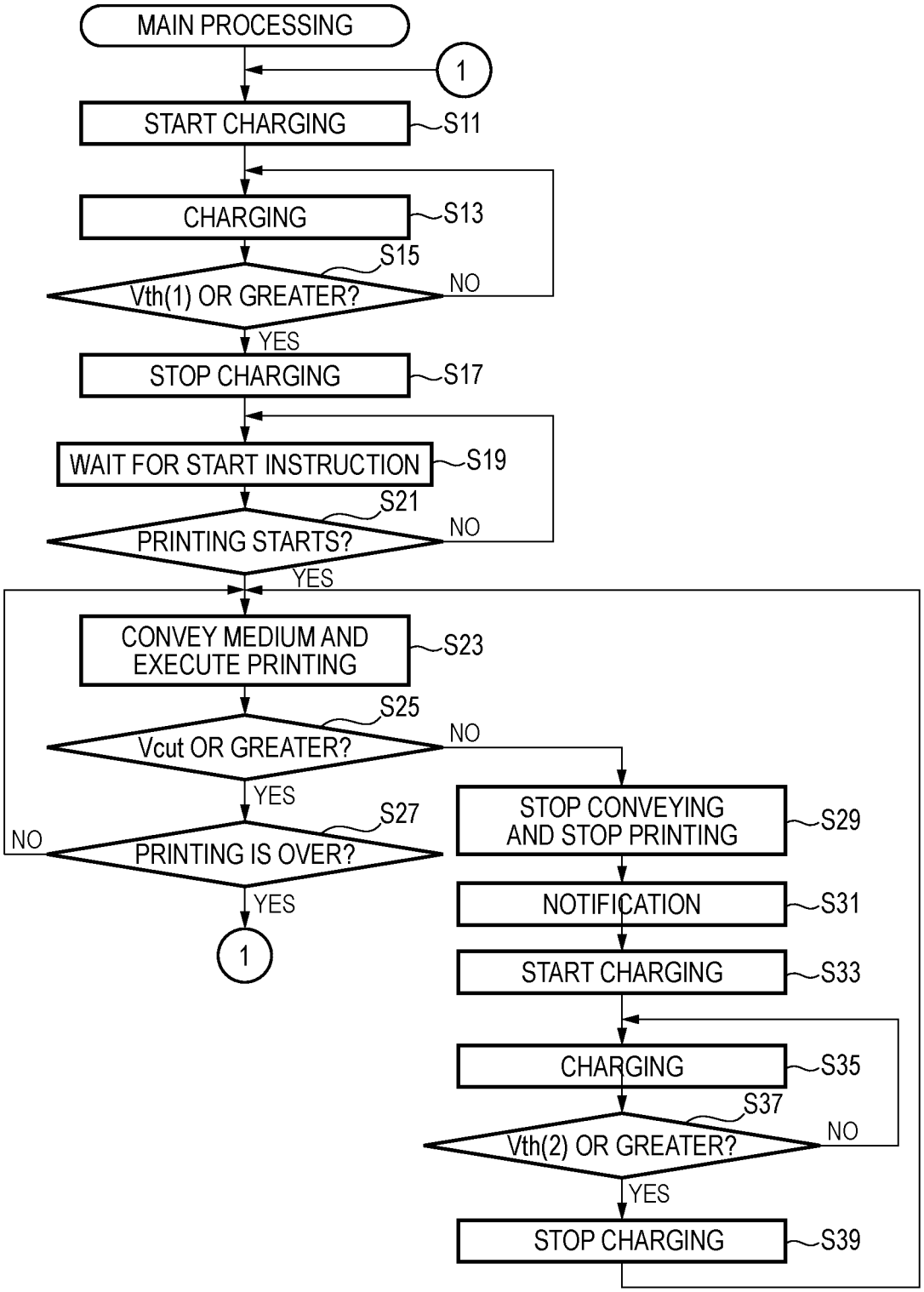
FIG. 6 is a flowchart of main processing.

Main processing is described with reference to FIG. 6. The main processing starts as the program stored in the flash memory 75 is read and executed by the CPU 71 when the power supply of the printing apparatus 1 becomes on.

The CPU 71 controls the charging unit 51 to switch the power supply system to the first system. Thereby, the CPU 71 starts the charging of the capacitor 52 (S11). The capacitor 52 is charged by the electric power of the dry-cell battery 11 (S13). The CPU 71 detects the voltage of the capacitor 52 by the detection unit 21. The CPU 71 determines whether the detected voltage of the capacitor 52 is equal to or greater than a predetermined first threshold value Vth(1) (S15). In a case where it is determined that the voltage of the capacitor 52 is smaller than the first threshold value Vth(1) (S15: NO), the CPU 71 returns the processing to S13, and continues the charging of the capacitor 52. In a case where it is determined that the voltage of the capacitor 52 is equal to or greater than the first threshold value Vth(1) (S15: YES), the CPU 71 controls the charging unit 51 to switch the power supply system from the first system to the second system. Thereby, the CPU 71 stops the charging of the capacitor 52 (S17).

The CPU 71 waits for an input of an instruction for starting printing (which is referred to as a start instruction) via the keyboard 3 (S19). In a case where it is determined that the start instruction is not input via the keyboard 3 (S21: NO), the CPU 71 returns the processing to S19, and continues to wait for the start instruction. In a case where it is determined that the start instruction is input via the keyboard 3 (S21: YES), the CPU 71 causes the processing to proceed to S23. The CPU 71 controls the tape feeding motor 23 to rotate the tape drive shaft 82, thereby starting to convey the tape 50 (S23). At the same time, the CPU 71 controls the thermal head 83 to generate heat, and executes printing on the tape 50 that is conveyed (S23). Note that, since the power supply system is switched to the second system by the processing of S17, the tape feeding motor 23 and the thermal head 83 are driven only with the electric power charged in the capacitor 52.

The CPU 71 detects the voltage of the capacitor 52 by the detection unit 21. The CPU 71 determines whether the detected voltage of the capacitor 52 is equal to or greater than a predetermined printing threshold value Vcut smaller than the first threshold value Vth(1) (S25). In a case where it is determined that the detected voltage of the capacitor 52 is equal to or greater than the printing threshold value Vcut (S25: YES), the CPU 71 causes the processing to proceed to S27. The CPU 71 determines whether an instruction for ending the printing (which is referred to as an ending instruction) is input via the keyboard 3 (S27). In a case where it is determined that the ending instruction is not input via the keyboard 3 (S27: NO), the CPU 71 returns the processing to S23, and continues to convey the tape 50 and to perform printing (S23).

In a case where it is determined that the detected voltage of the capacitor 52 is smaller than the printing threshold value Vcut (S25: NO), the CPU 71 causes the processing to proceed to S29. The CPU 71 controls the tape feeding motor 23 to stop the rotation of the tape drive shaft 82, thereby stopping the conveying of the tape 50 (S29). At the same time, the CPU 71 controls the thermal head 83 to stop heat generation and stops the printing on the tape 50 (S29). The CPU 71 displays a message for notifying that the charging of the capacitor 52 is required during the printing on the display 5, and notifies a user of the same (S31).

The CPU 71 controls the charging unit 51 to switch the power supply system to the first system. Thereby, the CPU 71 starts the charging of the capacitor 52 (S33). The capacitor 52 is charged by the electric power of the dry-cell battery 11 (S35). The CPU 71 detects the voltage of the capacitor 52 by the detection unit 21. The CPU 71 determines whether the detected voltage of the capacitor 52 is equal to or greater than a predetermined second threshold value Vth(2) larger than the printing threshold value Vcut (S37). In a case where it is determined that the detected voltage of the capacitor 52 is smaller than the second threshold value Vth(2) (S37: NO), the CPU 71 returns the processing to S35, and continues the charging of the capacitor 52. In a case where it is determined that the detected voltage of the capacitor 52 is equal to or greater than the second threshold value Vth(2) (S37: YES), the CPU 71 controls the charging unit 51 to switch the power supply system from the first system to the second system. Thereby, the CPU 71 stops the charging of the capacitor 52 (S39). The CPU 71 returns the processing to S23. Note that, a time after the printing is stopped by the processing of S29 until the charging of the capacitor 52 is completed is 20 to 30 seconds, for example.

The CPU 71 controls the tape feeding motor 23 to rotate the tape drive shaft 82, thereby resuming the conveying of the tape 50 (S23). At the same time, the CPU 71 controls the thermal head 83 to generate heat, and resumes the printing on the tape 50 that is conveyed (S23). Note that, since the power supply system is switched to the second system by the processing of S39, the tape feeding motor 23 and the thermal head 83 are driven only with the electric power charged in the capacitor 52.

In a case where it is determined that the ending instruction is input via the keyboard 3 (S27: YES), the CPU 71 returns the processing to S11.

Operations and Effects of Present Embodiment

The printing apparatus 1 includes the capacitor 52 capable of being charged by the electric power of the dry-cell battery 11. The printing apparatus 1 drives the thermal head 83 only with the electric power charged in the capacitor 52, and printing can be performed on the tape 50 with a favorable print quality. Note that, the printing apparatus 1 does not require many dry-cell batteries 11 as a power supply for driving the thermal head 83. For example, when securing the electric power for driving the thermal head 83 with the 1.5V dry-cell battery 11, it is usually necessary to directly connect and use about six dry-cell batteries 11. In contrast, when securing the electric power for charging the capacitor 52 with the 1.5V dry-cell battery, four dry-cell batteries 11 are used. Therefore, as compared to the related art, it is possible to reduce a space corresponding to the two dry-cell batteries 11. In this way, since a size of the battery accommodation part 110 for accommodating the dry-cell battery 11 can be reduced, the printing apparatus 1 can be miniaturized and lightened.

The printing apparatus 1 includes the capacitor 52 as an electric power source for driving the thermal head 83. The capacitor 52 is a lithium-ion capacitor, and can be used at higher voltages than the usual electric double layer capacitor. Therefore, the printing apparatus 1 can appropriately secure the electric power for driving the thermal head 83 by the capacitor 52.

The printing apparatus 1 conveys the tape 50 by driving the tape feeding motor 23 only with the electric power charged in the capacitor 52. In this case, the printing apparatus 1 does not require many dry-cell batteries 11 as a power supply for driving the tape feeding motor 23. Therefore, since the size of the battery accommodation part 110 for accommodating the dry-cell battery 11 can be further reduced, the printing apparatus 1 can be further miniaturized and lightened.

When the voltage of the capacitor 52 is lowered during the printing (S25: NO), the printing apparatus 1 stops the printing (S29) and charges the capacitor 52 (S35). The printing apparatus 1 resumes the stopped printing (S23) after the charging of the capacitor 52 (S37: YES). In this case, even when the voltage of the capacitor 52 is lowered during the printing, the printing apparatus 1 can temporarily stop the printing and resume the printing. Therefore, the printing apparatus 1 can prevent the printing from being ended during the printing due to lowering in voltage of the capacitor 52.

When the voltage of the capacitor 52 is lowered during the printing (S25: NO), the printing apparatus 1 stops the printing (S29), and notifies the same to the user (S31). Therefore, the printing apparatus 1 can notify the user that the charging of the capacitor 52 is required during the printing.

Modified Embodiments

The present disclosure is not limited to the above embodiment, and a variety of changes can be made. The number of the dry-cell batteries 11 is not limited to four and may be 1-3 or 5 or larger. The standard of the dry-cell battery 11 is not limited to the AAA type, and may be a single type, a size C type or an AA type. The dry-cell battery 11 may be any battery such as a manganese dry-cell battery, an alkaline dry-cell battery, a nickel dry-cell battery, a lithium dry-cell battery and the like. The dry-cell battery 11 may also be any secondary battery of a single type, a size C type, an AA type and an AAA type that can be repeatedly used by charging. In this case, the dry-cell battery 11 may be a lithium-ion secondary battery, a nickel hydrogen battery or the like. The detection unit 21 may also be an AD converter, a comparator or the like provided separately from the CPU 71. The diverse devices included in the control circuit unit 70 may be directly connected to the dry-cell battery 11 without passing through the charging unit 51. In this case, the charging unit 51 may function as a switch for switching a state in which the electric power of the dry-cell battery 11 is supplied to the capacitor 52 and a state in which the electric power is not supplied, and does not necessarily need to supply the electric power of the dry-cell battery 11 to the control circuit unit 70.

The capacitor 52 may also be configured by one lithium-ion capacitor or by a plurality of lithium-ion capacitors connected in series or in parallel. The capacitor 52 is not limited to the lithium-ion capacitor, and may also be an electric double layer capacitor. Note that, the electric double layer capacitor can perform charging and discharging at large currents because an internal resistance thereof is small. For this reason, similarly to the case where the lithium-ion capacitor is used as the capacitor 52, the printing apparatus 1 can appropriately drive the thermal head 83 and the tape feeding motor 23 by the electric double layer capacitor.

The capacitor 52 may supply the electric power to the display 5 and the like, in addition to the thermal head 83 and the tape feeding motor 23. Also, the capacitor 52 may supply the electric power to only the thermal head 83, and may not supply the electric power to the tape feeding motor 23. In this case, the tape feeding motor 23 may be driven by the electric power supplied from the dry-cell battery 11.

The type of notification, which is issued when the voltage of the capacitor 52 becomes smaller than the printing threshold value Vcut (S25: NO) during the printing, is not limited to the above embodiment. For example, the printing apparatus 1 may display a message for notifying that the printing is temporarily stopped on the display 5. Also, for example, the printing apparatus 1 may notify the user by lighting of an LED, a warning sound by a buzzer, and the like. The printing apparatus 1 does not necessarily need to issue the notification when the voltage of the capacitor 52 becomes smaller than the printing threshold value Vcut during the printing.

When the voltage of the capacitor 52 becomes smaller than the printing threshold value Vcut (S25: NO) during the printing, the printing apparatus 1 may control the charging unit 51 to switch the power supply system from the second system to the first system and to charge the capacitor 52 while continuing the printing. That is, the printing apparatus 1 may charge the capacitor 52 while performing the printing. In this case, a time required to end the printing can be shortened. On the other hand, when the voltage of the capacitor 52 becomes smaller than the printing threshold value Vcut (S25: NO) during the printing, the printing apparatus 1 may end the printing without performing the charging of the capacitor 52.

The first threshold value Vth(1) and the second threshold value Vth(2) may be different values or the same value. Note that, for example, when the first threshold value Vth(1) is set larger than the second threshold value Vth(2), it is possible to increase a possibility that the charging of the capacitor 52 will be performed at the time the power supply of the printing apparatus 1 becomes on. In this case, it is possible to charge the capacitor 52 while effectively utilizing a time until the start instruction is input via the keyboard 3. Also, it is possible to suppress a frequency with which the charging of the capacitor 52 is performed during the printing. Note that, the first threshold value Vth(1), the second threshold value Vth(2) and the printing threshold value Vcut may be set by the user.

In the main processing, S11-S17 does not necessarily need to be executed. In a case where it is determined that the voltage of the capacitor 52 is smaller than the printing threshold value Vcut (S25: NO) at a time at which it is determined that the start instruction is input via the keyboard 3, the printing apparatus 1 may control the charging unit 51 to switch the power supply system from the second system to the first system and to charge the capacitor 52. That is, the charging of the capacitor 52 does not necessarily need to be performed before the start instruction is input via the keyboard 3.

The printing apparatus 1 is not limited to a thermal printer in which the thermal head is used, and may also be a printing apparatus having a printing unit for performing printing in another method (an inkjet method, a laser method and the like). As the power supply for charging the capacitor 52, a DC power supply (referred to as a second power supply) to which electric power is supplied from an AC adapter, and the like may also be used, instead of the dry-cell battery 11 such as a primary battery and a secondary battery. Instead of the capacitor 52, a power supply (referred to as a first power supply) such as a battery that can be charged and discharged by the second power supply may also be used. In this case, the printing apparatus can drive the printing unit only with the electric power charged in the first power supply, and perform printing on the tape 50 with the favorable print quality.

The printing apparatus 1 may also include a temperature detection unit (thermistor and the like) that can detect a temperature of the thermal head 83 and/or a temperature in the printing apparatus 1. The CPU 71 may change the second threshold value Vth(2), according to a temperature detected by the temperature detection unit. In this case, the printing apparatus 1 can determine whether it is necessary to charge the capacitor 52 by using the appropriate second threshold value Vth(2) corresponding to a temperature of the thermal head 83 and/or a temperature in the printing apparatus 1.

After the printing is over, the printing apparatus 1 may calculate the consumed electric power of the capacitor 52, based on print data during the printing, and determine whether it is necessary to charge the capacitor 52 until next printing starts. Also, when it is necessary to charge the capacitor 52, the printing apparatus 1 may further calculate a necessary charging time. The printing apparatus 1 may charge the capacitor 52, based on the calculated charging time, before the next printing starts.

<Others>

The processing of S35 is an example of "the charging control" of the present disclosure. The processing of S23 is an example of "the printing control" of the present disclosure. The processing of S29 is an example of "the stop control" the present disclosure. The processing of S31 is an example of "the notification control" of the present disclosure. The tape feeding motor 23 is an example of "the motor" of the present disclosure. The tape drive shaft 82 is an example of "the conveying mechanism" of the present disclosure. The tape 50 is an example of "the printing medium" of the present disclosure.

What is claimed is:

1. A printing apparatus comprising:

a thermal head;

a capacitor capable of being charged and discharged;

a detection unit configured to detect a voltage of the capacitor;

a battery accommodation part configured to accommodate a dry-cell battery configured to supply electric power for charging the capacitor;

a charging unit configured to charge the capacitor by the electric power of the dry-cell battery; and a controller configured to:

execute charging control of controlling the charging unit to charge the capacitor by the electric power of the dry-cell battery, and execute printing control of performing printing on a printing medium by driving the thermal head only with the electric power charged in the capacitor, depending on the voltage detected by the detection unit, wherein the charging unit includes an upstream switch provided upstream from the capacitor and a downstream switch provided downstream from the capacitor, wherein in the charging control, the controller is configured to:

turn on the upstream switch such that the dry-cell battery and the capacitor is connected, and turn off the downstream switch such that the capacitor and the thermal head is disconnected, and wherein in the printing control, the controller is configured to:

turn off the upstream switch such that the dry-cell battery and the capacitor is disconnected, and turn on the downstream switch such that the capacitor and the thermal head is connected.

2. The printing apparatus according to claim 1, wherein the capacitor is a lithium-ion capacitor or an electric double layer capacitor.

3. The printing apparatus according to claim 1, further comprising:

a motor for operating a conveying mechanism configured to convey the printing medium, wherein the controller is further configured to:

execute conveying control of causing the conveying mechanism to convey the printing medium by driving the motor only with the electric power charged in the capacitor, and wherein, in the printing control, printing is performed while conveying the printing medium by the conveying control.

4. The printing apparatus according to claim 1, wherein the controller is further configured to execute stop control of stopping the printing by stopping the driving of the thermal head, in a case where the voltage detected by the detection unit becomes smaller than a predetermined threshold value during the printing by the printing control.

5. The printing apparatus according to claim 4, wherein the controller is further configured to:

execute notification control of performing a notification when the printing is stopped by the stop control.

6. The printing apparatus according to claim 4, wherein, in the charging control, the charging unit is controlled to charge the capacitor by the electric power of the dry-cell battery after stopping the printing by the stop control.

7. The printing apparatus according to claim 6, wherein the printing control resumes the printing stopped by the stop control after the capacitor is charged by the charging control, and performs the printing on the printing medium by driving the thermal head only with the electric power charged in the capacitor.

8. A printing apparatus comprising:

a printing unit;

a first power supply capable of being charged and discharged;

a detection unit configured to detect a voltage of the first power supply;

a battery accommodation part configured to accommodate a second power supply configured to supply electric power for charging the first power supply;

a charging unit configured to charge the first power supply by the electric power of the second power supply; and a controller configured to:

execute charging control of controlling the charging unit to charge the first power supply by the electric power of the second power supply, and execute printing control of performing printing on a printing medium by driving the printing unit only with the electric power charged in the first power supply, depending on the voltage detected by the detection unit, wherein the charging unit includes an upstream switch provided upstream from the first power and a downstream switch provided downstream from the first power, wherein in the charging control, the controller is configured to:

turn on the upstream switch such that the second power and the first power is connected, and turn off the downstream switch such that the first power and the printing unit is disconnected, and wherein in the printing control, the controller is configured to:

turn off the upstream switch such that the second power and the first power is disconnected, and turn on the downstream switch such that the first power and the printing unit is connected.

9. The printing apparatus according to claim 8, wherein the first power supply is a lithium-ion capacitor or an electric double layer capacitor.

10. The printing apparatus according to claim 8, further comprising:

a motor for operating a conveying mechanism configured to convey the printing medium, wherein the controller is further configured to:

execute conveying control of causing the conveying mechanism to convey the printing medium by driving the motor only with the electric power charged in the first power supply, and wherein, in the printing control, printing is performed while conveying the printing medium by the conveying control.

11. The printing apparatus according to claim 8, wherein the controller is further configured to execute stop control of stopping the printing by stopping the driving of the printing unit, in a case where the voltage detected by the detection unit becomes smaller than a predetermined threshold value during the printing by the printing control.

12. The printing apparatus according to claim 11, wherein the controller is further configured to:

execute notification control of performing a notification when the printing is stopped by the stop control.

13. The printing apparatus according to claim 11, wherein, in the charging control, the charging unit is controlled to charge the first power supply by the electric power of the second power supply after stopping the printing by the stop control.

14. The printing apparatus according to claim 13, wherein the printing control resumes the printing stopped by the stop control after the first power supply is charged by the charging control, and performs the printing on the printing medium by driving the printing unit only with the electric power charged in the first power supply.

* * * * *